US007966961B2

(12) United States Patent
Carr

(10) Patent No.: US 7,966,961 B2
(45) Date of Patent: Jun. 28, 2011

(54) PONTOONS

(76) Inventor: Shane Allen Carr, Cornwall (GB)

( * ) Notice: Subject to any disclaimer, the term of this patent is extended or adjusted under 35 U.S.C. 154(b) by 88 days.

(21) Appl. No.: 12/279,411

(22) PCT Filed: Feb. 2, 2007

(86) PCT No.: PCT/GB2007/000354

§ 371 (c)(1),
(2), (4) Date: Aug. 14, 2008

(87) PCT Pub. No.: WO2007/093762

PCT Pub. Date: Aug. 23, 2007

(65) Prior Publication Data

US 2009/0020064 A1 Jan. 22, 2009

(30) Foreign Application Priority Data

Feb. 14, 2006 (GB) ..... 0603027.4

(51) Int. Cl.
*B63B 35/44* (2006.01)

(52) U.S. Cl. ..... 114/263

(58) Field of Classification Search ..... 114/61.1, 114/263
See application file for complete search history.

(56) References Cited

U.S. PATENT DOCUMENTS

| | | | | |
|---|---|---|---|---|
| 3,799,093 | A | 3/1974 | Thomson | |
| 3,844,236 | A | 10/1974 | Boyajian | |
| 4,993,350 | A * | 2/1991 | Pepper | 114/292 |
| 5,192,161 | A | 3/1993 | Helgesson et al. | |
| 5,732,649 | A | 3/1998 | Falcone | |
| 2004/0040488 | A1 | 3/2004 | Trepanier | |
| 2006/0029470 | A1 * | 2/2006 | Berlin | 405/4 |
| 2007/0017427 | A1 * | 1/2007 | Rytand | 114/263 |

FOREIGN PATENT DOCUMENTS

| | | |
|---|---|---|
| GB | 121613 | 1/1919 |
| GB | 966036 | 8/1964 |

* cited by examiner

*Primary Examiner* — Stephen Avila
(74) *Attorney, Agent, or Firm* — Brooks Kushman P.C.

(57) ABSTRACT

A pontoon structure consisting of two concrete side members with a buoyancy member interposed between them, a plurality of transverse members linking the side members and a deck extending between the side members.

18 Claims, 2 Drawing Sheets

PONTOONS

Figures 1, 3:
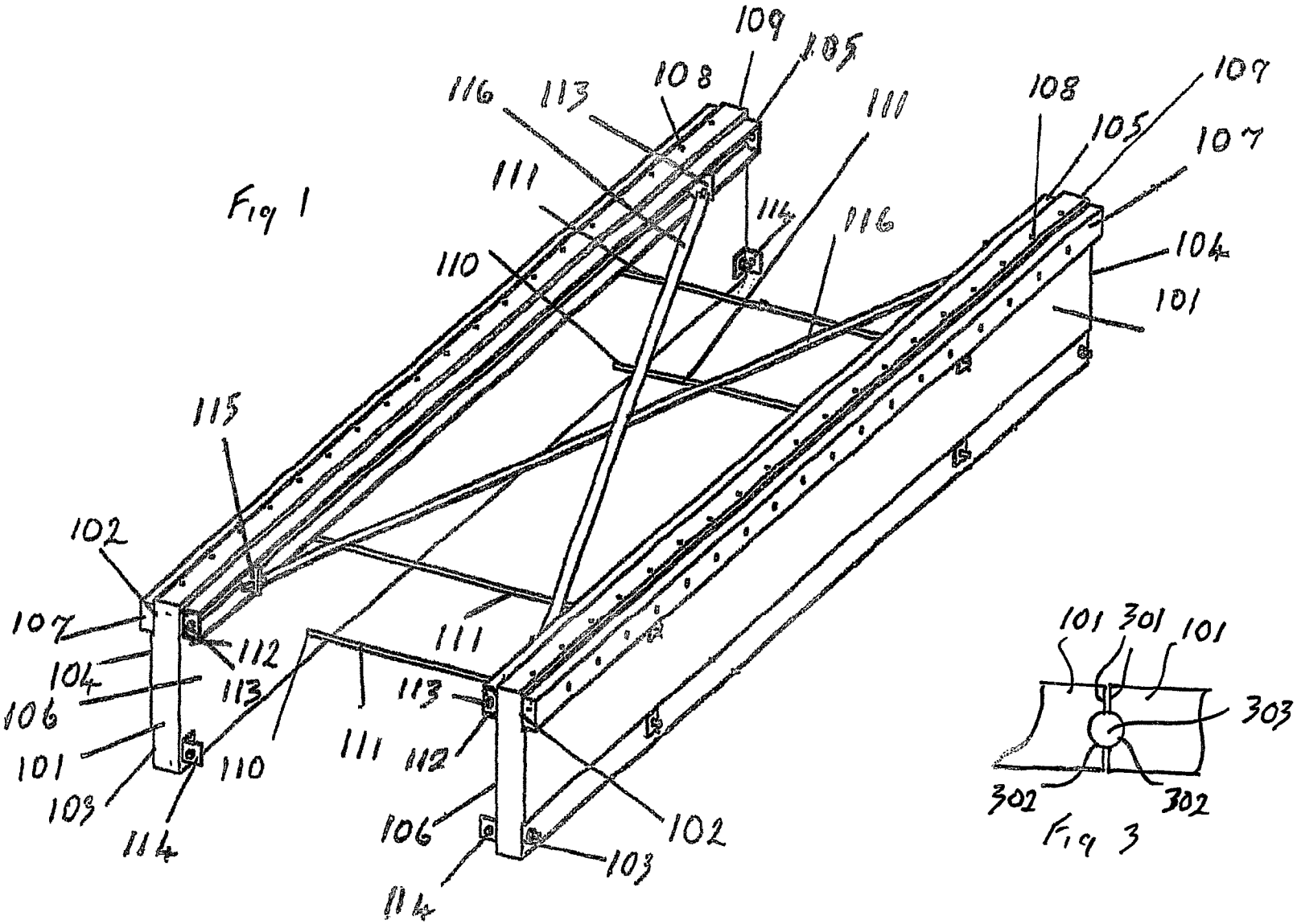

The present invention relates to pontoons and more specifically to pontoons for use in providing berthing structures for vessels.

Pontoons are floating platforms, which frequently are used to provide berthing structures for use with relatively small vessels, although they can be used for other purposes where it is desired to provide platforms which can follow the rise and fall of tides or the surfaces of other bodies of water.

One type of pontoon consists of an open box girder structure, which surrounds and encloses a buoyancy provider in the form of a block, or blocks, of an expanded plastics material such as expanded polystyrene. On the upper surface of the box girder structure there is laid a decking which provides a traffic-bearing surface. As plastics materials such as polystyrene can be damaged, if not dissolved, by petroleum or its by-products, it is usual practice to encase the plastics material in an inert material such as concrete, which, of course, reduces the effective buoyancy of the polystyrene.

Another type of pontoon consists of an elongated concrete member of channel section which has transverse ribs which form a series of open-ended cells. The cells are filled with an expanded plastics material such as expanded polystyrene so as to provide buoyancy for the structure in use. In use, the channel-sectioned member is positioned the open ends of the cells downwards so that they are below the surface of the water in which the pontoon is floating. This protects the plastics material from petroleum-based contaminants, which, being lighter than water, float. The exposed upper concrete surface can be used directly as a traffic-bearing surface, it can be covered with a material having a higher co-efficient of friction when wet than does concrete, such as asphalt or wood.

Neither of these types of pontoon structure is entirely satisfactory. Each is relatively expensive to produce and does not lend itself to fabrication on site.

It is an object of the present invention to provide a pontoon structure which is cheaper to produce than existing types of pontoon structure and which lends itself to fabrication on site, if so desired.

According to the present invention in one aspect there is provided a pontoon structure comprising a pair of longitudinally extending side members of generally rectangular cross-section positioned parallel to each other with opposed major surfaces, a buoyancy member interposed between the side members, a plurality of transverse members linking the side members and a traffic-bearing surface extending between the side members.

Preferably, the side members are provided with inwardly-directed projections against which, in use, the buoyancy member can bear. The inwardly-directed projections also can provide mountings for decking to provide the traffic-bearing surface of the pontoon.

Preferably, the side members comprise pre-cast concrete beams with opposed holes through which the transverse members pass. In this case, the inwardly-directed projections can be integral with the side members.

Alternatively each side member can be provided with a series of transverse holes in the upper region thereof, by means of which a longitudinally-extending deck support member can be attached to one side of the side member and a fender or buffer can be attached to the other side of the side member. In this case, the deck support member comprises the inwardly-directed projection of the side member concerned.

Preferably, the deck support member is of channel-section with closed ends having holes formed in them by means of which side members can be joined longitudinally, and intermediate transverse webs by means of which cross-braces can be provided between the side members so as to prevent relative longitudinal movement there between.

Each end of the side members can be provided with a depression extending along its major transverse dimension adapted to provide an housing for a resilient sealing member interposed between adjacent side members. The resilient sealing members also can provide for a degree of relative motion between adjacent side members, if so desired.

The invention will now be described, by way of example only, with reference to the accompanying drawings, in which:—

Figure 4:
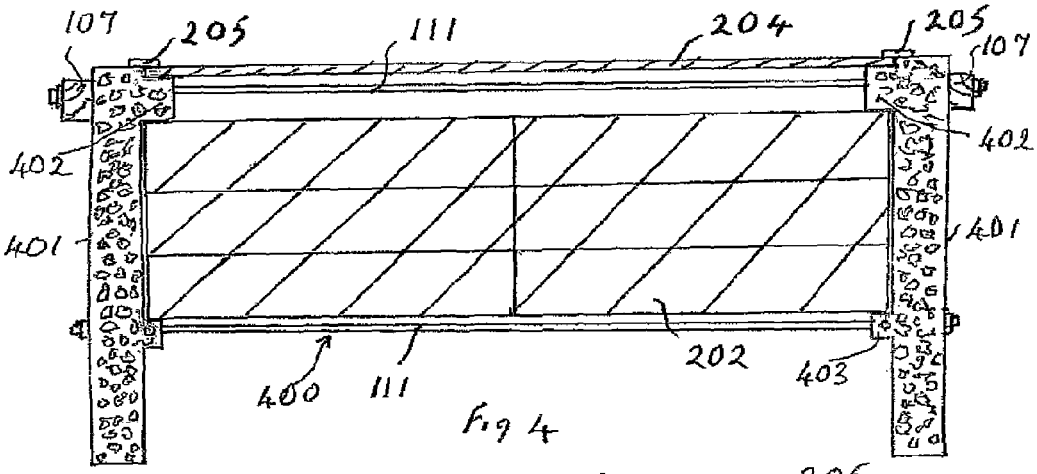
Figure 5:
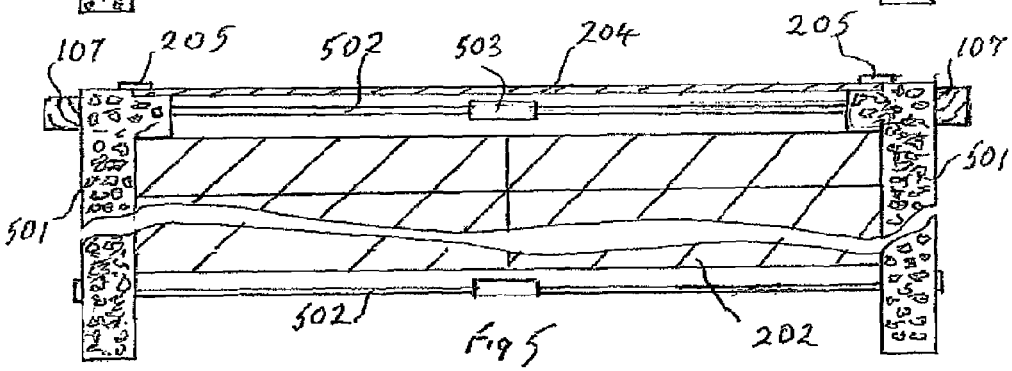

FIG. 1 is a pictorial representation of a pontoon embodying the present invention. In the interests of clarity, both the buoyancy member and the decking have been omitted from the figure, FIG. 2 is a cross-section of the pontoon shown in FIG. 1, FIG. 3 is a plan view of the junction between the side members of two pontoons as shown FIG. 1 in which there is incorporated a sealing element, FIG. 4 is cross-section of a second pontoon structure embodying the invention and FIG. 5 is a cross-section of a third pontoon structure embodying the invention.

Referring to FIG. 1 of the drawings, the outer structure of a pontoon assembly embodying the invention consists of two side members 101 in the form of cast concrete beams. The side members 101 have a generally rectangular cross-section apart from two shallow reliefs 102, 103 at the top and bottom, respectively, of the outer surfaces 104 side members 101 (as shown in the drawing). Formed into the concrete of the side members 101 along the lengths of the reliefs 102 are transverse holes (not shown in FIG. 1) by means of which deck support members 105 are attached to the inner surfaces 106 of the side members 101, and wooden or other suitable material, fenders or buffers, 107 are attached to the outer surfaces 104 of the side members 101. These holes may also be used for the attachment of pile guides to the sides of the pontoon assembly or for the attachment of other pontoon assemblies at right angles to the first pontoon assembly to form what are known as finger pontoons. Vertical holes 108 are formed in the upper surfaces 109 of the side members 101. These provide fixing points for cover strips which retain in position decking material (not shown in the drawing), which spans between the side members 101 and also for items such as mooring cleats or bollards. Also formed in the side members 101 are holes 110 through which pass tie rods 111. The deck support members 105, which, suitably, may be made of galvanized iron, are of channel section with end closures 112 in which are holes 113 by means of which adjacent side members 101 can be joined longitudinally, so enabling elongated pontoon structures to be constructed. Corresponding fixing brackets 114 are attached to the lower parts of the ends of the inner surfaces 106 of the side members 101. Also present in the deck support members 105 are webs 115 which provide mounting points for cross-braces 116, which prevent relative longitudinal movement between the side members 101.

Figure 2:
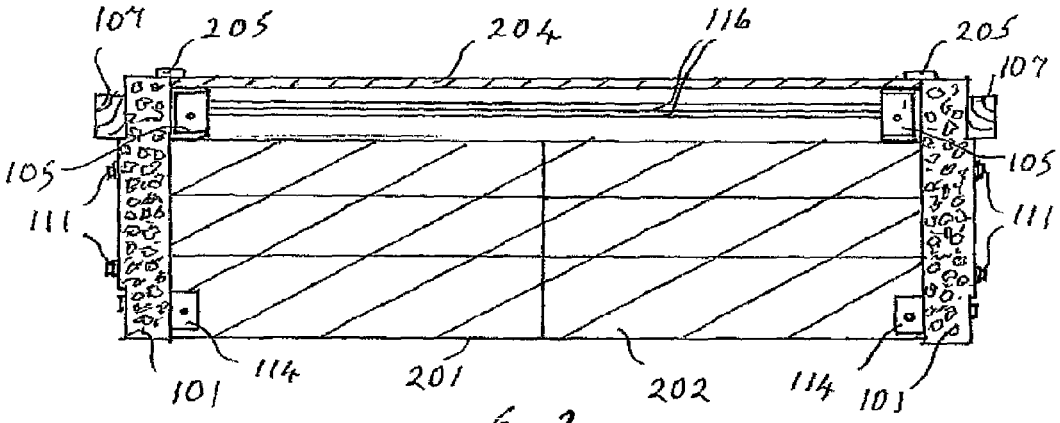

Referring to FIG. 2 of the drawings, interposed between the side members 101 is a buoyancy member 201 consisting of an assembly of blocks 202 of an expanded plastics material such as expanded polystyrene, the tops of which abut the undersides of the deck support members 105, which act as reaction points for upward forces generated by the polystyrene blocks 202. Although polystyrene readily is damaged by point loads, it is surprisingly resistant to distributed load and considerable tension loads can be applied to the tie rods 111 to hold the assembly together. Although these loads can be sufficient to enable the friction forces between the polystyrene blocks 202 and the inner surfaces 106 of the side members 101 to resist both the vertical buoyancy forces and racking forces, it is better not to rely on this and to ensure that the polystyrene blocks 202 do abut the lower surfaces of the deck support members 105 and to incorporate the cross-braces 116. A deck 204 is laid across the tops of the deck support members 105 and held in place by cover strips 205, which are held in place by means of fixings inserted into some of the holes 108 in the upper surfaces 109 of the side members 101. The deck 204 can be slats of wood, metal or (preferably recycled) plastics material, or sheets of such materials. Although they are not shown in FIG. 2, if so desired, intermediate longitudinal bearers for the deck can be included. In this case, the material forming the deck 204 can be cut and fastened to the intermediate bearers so as to provide a channel for service cables, or pipes.

In use, the side members 101 protect the sides of the polystyrene blocks 202 from contact with petroleum-based contaminants, which might damage them. The tops and end surfaces of the assembly of polystyrene blocks 202 also should be so protected. The tops of the polystyrene blocks 202 can be protected by a sheet of impervious material laid on them, or by a skim of cement laid in situ, but some waterproof barrier has to be positioned against the exposed ends of the assembly of polystyrene blocks 202. Again, this can be as simple as a skim of concrete, or a separate closure member such as another concrete beam or a sheet of impervious plastics material.

Referring to FIG. 3 of the drawings, there is shown the ends of two adjacent side members 101 which have been modified to accept a sealing strip between them so as to reduce the chance of damage to the ends of the assemblies of polystyrene blocks 202, which are associated with the side members 101, due to floating petroleum-based pollutants. The ends 301 of the side members 101 have recesses 302 formed in them in which are housed resilient sealing strips 303. The sealing strips 303 also allow for a degree of movement and compliance between adjacent pontoon assemblies. As shown, the sealing strips 303 have circular cross-section but they can have other cross-sections, such as square or rectangular. If separate closure members are used to seal the ends of modules of pontoon structures, then provision should be made for similar sealing strips to be incorporated between the ends of the side members 101 and the closure member.

FIG. 4 shows a cross-section of a second pontoon structure embodying the invention in which those components which correspond with similar components of the first embodiment of the invention have the same reference numerals. Referring to FIG. 4, a pontoon structure 400 is generally similar to that described above, but has side members 401 in which the deck support members 105 are replaced by inwardly-directed ledges 402, which are integral parts of the side members 401. The side members 401 also include inwardly-directed lower ledges 403. Flotation again is provided by polystyrene blocks 202, which are situated between the ledges 402 and 403. The side members 401 project downwardly beyond the polystyrene blocks 202. This deepens the draft of the pontoon structure and improves its wave-breaking properties. In this design, the reliefs 102, 103 are omitted, as indeed, they can be from the side members 101 of the first embodiment of the invention, described above.

FIG. 5 shows a cross-section of a third embodiment of the invention. In this embodiment of the invention, the lower inwardly-directed ledges 403 are omitted from side members 501 and tie rods 502 are provided with bottle-screw type tensioners 503.

Tensioners of this type can be used with the first and second embodiments of the invention also, if so desired.

The side members of the pontoons can be produced in standard lengths so as to enable pontoon modules of the same length to be constructed, which then can be joined together as described, to produce pontoons of a desired length. Alternatively, the side members can be made to lengths specified for a particular purpose. Also, the depth of the side members is a matter of design choice.

An advantage of the present invention is that modules of pontoon structure can be supplied ready-made or they can be constructed on site.

Although as described, the side members 101 are made of concrete, they could be made of other materials such as wood, or metal, aluminium being an example.

The invention claimed is:

1. A pontoon structure assembly comprising:

a pair of longitudinal side members parallel to and spaced apart from one another so as to define an open top and bottom therebetween and two open ends, the side members each having a shoulder extending partially towards the other side member;

a buoyancy member disposed between the side members; and a plurality of tensile members connecting the side members and providing a compression force that constrains the buoyancy member between the side members;

wherein the shoulders restrain the buoyancy member from moving in a direction of a buoyant force, and the buoyancy member comprises an assembly of blocks of an expanded plastics material which are maintained in position between the side members by means of compression forces generated by tension in the members linking the side members.

2. The pontoon structure assembly according to claim 1 wherein a traffic-bearing surface is provided by a deck structure bearing on deck support members extending along the side members.

3. The pontoon structure assembly according to claim 1 wherein the tensile members comprise tie rods which pass through holes in the side members.

4. The pontoon structure assembly according to claim 1 wherein there is provided a cross-brace between the side members adapted to prevent relative longitudinal movement between the side members.

5. The pontoon structure assembly according to claim 1 wherein there is included means for joining lengths of side members together longitudinally.

6. The pontoon structure assembly according to claim 1 wherein deck support members are integral with the side members.

7. The pontoon structure assembly according to claim 2 wherein the deck support members comprise open channel-section members extending along inward-facing surfaces of the side members.

8. The pontoon structure assembly according to claim 7 wherein upper brackets for accepting fasteners for joining the side members together longitudinally comprise end-closures of the channel-section of the deck support members.

9. The pontoon structure assembly according to claim 7 wherein the channel-section deck support members include webs to which a cross-brace can be attached.

10. The pontoon structure assembly according to claim 1 wherein outer surfaces of the side members are provided with longitudinally-extending fenders.

11. The pontoon structure assembly according to claim 1 wherein there is provided means for sealing gaps between the ends of side members which are joined together longitudinally thereby to prevent water gaining access to the blocks of expanded plastics material through the gaps.

12. The pontoon structure assembly according to claim 2 wherein there is provided intermediate the deck support members additional longitudinal bearers for the deck and the deck includes a section between two of the additional deck bearers which can be detached so as to provide a channel in which can be laid service pipes or cables.

13. The pontoon structure assembly according to claim 1 wherein there is included a closure member between the open ends of the pontoon structure assembly.

14. The pontoon structure assembly according to claim 1 wherein the side members are adapted to extend below the buoyancy member.

15. The pontoon structure assembly according to claim 1, wherein the side members are made of a precast concrete.

16. The pontoon structure assembly according to claim 1, wherein the side members each include a ledge disposed below the buoyancy member to restrain the buoyancy member from moving in a direction opposite the buoyant force.

17. The pontoon structure assembly according to claim 1, further comprising a traffic bearing surface above the open top that extends between the side members.

18. The pontoon structure assembly according to claim 1, wherein the side members each include end supports at each open end that extend partially towards the other side member to restrain the buoyancy member from moving in a lateral direction.

* * * * *